US007346988B2

(12) United States Patent
Gringer et al.

(10) Patent No.: US 7,346,988 B2
(45) Date of Patent: Mar. 25, 2008

(54) SOFT HANDLE NON-RETRACTABLE UTILITY KNIFE WITH QUICK RELEASE LATCH AND METHOD FOR MAKING SAME

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 418 days.

(21) Appl. No.: 10/241,027

(22) Filed: Sep. 11, 2002

(65) Prior Publication Data

US 2004/0045167 A1 Mar. 11, 2004

(51) Int. Cl.
*B26B 3/00* (2006.01)

(52) U.S. Cl. ..... 30/151; 30/329; 30/339

(58) Field of Classification Search ..... 30/125, 30/329, 337–339, 151–162; D8/98–100, D8/107; 76/104.1

See application file for complete search history.

(56) References Cited

U.S. PATENT DOCUMENTS

| | | | | |
|---|---|---|---|---|
| 2,119,045 | A | 5/1938 | Deitrich | |
| 2,245,096 | A | 6/1941 | Penney | |
| 2,336,284 | A | 12/1943 | Nelson | |
| 2,376,887 | A | 5/1945 | Walters | |
| 2,862,296 | A | 12/1958 | Anderson | |
| 2,948,961 | A | 8/1960 | Ortner | |
| 3,107,426 | A | 10/1963 | Robinson, Jr. | |
| 3,192,624 | A | 7/1965 | Gringer | |
| 3,667,122 | A | 6/1972 | Black | |
| 4,005,525 | A | 2/1977 | Gringer | |
| 4,805,304 | A | 2/1989 | Knoop | |
| 5,022,156 | A * | 6/1991 | Kallens et al. | 30/125 |
| 5,025,558 | A * | 6/1991 | Gilbert | 30/162 |
| 5,121,544 | A | 6/1992 | Gilbert | |

(Continued)

FOREIGN PATENT DOCUMENTS

WO WO 00/06347 2/2000

OTHER PUBLICATIONS

Allway Tools®, Soft Grip Tools for Hard Hat® Jobs, 2005, pp. 4-5.*

(Continued)

*Primary Examiner*—Jason Prone
(74) *Attorney, Agent, or Firm*—Gottlieb, Rackman & Reisman, P.C.

(57) ABSTRACT

A metallic housing utility knife and method for making the device with a soft over molded elastomeric cover to provide blister free comfort and slip proof safety. The cover or skin is molded into the unique structure of the housing in a fashion that results in mechanical bonds that embrace the cover on the housing. The knife includes flexible posts from the cover that project into the blade storage compartment of the housing to prevent internally stored spare blades from moving within the storage compartment. An elastomeric blade clamp integrally formed with the cover serves to restrict lateral movement of blades of varying sizes when installed in a cutting position within the knife assembly. A rear quick release latch and interlocking housing sections provide a convenient way to open and close the knife and assure that it is also secure and firmly held when locked in a safe cutting position.

6 Claims, 10 Drawing Sheets

U.S. PATENT DOCUMENTS

| | | | | | |
|---|---|---|---|---|---|
| 5,141,517 | A | | 8/1992 | Shutt | |
| 5,386,632 | A | * | 2/1995 | Schmidt | 30/125 |
| 5,400,509 | A | * | 3/1995 | Collins | 30/161 |
| 5,426,855 | A | | 6/1995 | Keklak et al. | |
| 5,433,004 | A | * | 7/1995 | Thompson et al. | 30/169 |
| 5,435,064 | A | * | 7/1995 | Brookfield | 30/169 |
| 5,495,673 | A | * | 3/1996 | Gardiner et al. | 30/155 |
| 5,528,832 | A | | 6/1996 | Schmidt | |
| 5,528,834 | A | * | 6/1996 | Seber et al. | 30/340 |
| 5,545,175 | A | | 8/1996 | Abidin et al. | |
| 5,581,890 | A | | 12/1996 | Schmidt | |
| 5,621,973 | A | * | 4/1997 | Seber et al. | 30/161 |
| 5,694,692 | A | * | 12/1997 | Reinschreiber | 76/104.1 |
| 5,769,094 | A | * | 6/1998 | Jenkins, Jr. et al. | 30/161 |
| 5,813,121 | A | | 9/1998 | Gringer | |
| D411,429 | S | | 6/1999 | Gringer | |
| 5,911,761 | A | * | 6/1999 | Tilley | 30/162 |
| 5,956,788 | A | * | 9/1999 | Henke | 7/105 |
| 6,026,575 | A | * | 2/2000 | Wonderley | 30/125 |
| 6,044,562 | A | | 4/2000 | Dillenbeck | |
| 6,058,607 | A | | 5/2000 | Gringer | |
| 6,161,290 | A | * | 12/2000 | Takamasa | 30/162 |
| 6,219,923 | B1 | | 4/2001 | Sinisi et al. | |
| 6,286,215 | B1 | | 9/2001 | Panaccione | |
| 6,349,473 | B1 | | 2/2002 | Schmidt | |
| 6,415,514 | B1 | * | 7/2002 | Chun | 30/162 |
| 6,438,849 | B1 | | 8/2002 | Wonderley | |
| D478,493 | S | * | 8/2003 | Martone et al. | D8/99 |
| 6,907,668 | B2 | * | 6/2005 | Polei | 30/162 |
| 7,055,407 | B2 | * | 6/2006 | Gringer et al. | 30/343 |
| D531,003 | S | * | 10/2006 | Collins | D8/107 |

OTHER PUBLICATIONS

Stanley Hand Tools, 10-799-7" FatMax™ Swivel-Lock Fixed Blade Utility Knife, www.stanleytools.com , Nov. 4, 2004.

* cited by examiner

SOFT HANDLE NON-RETRACTABLE UTILITY KNIFE WITH QUICK RELEASE LATCH AND METHOD FOR MAKING SAME

FIELD OF THE INVENTION

The present invention relates to utility knives, and more particularly to a non-retractable utility knife with a durable metallic blade carrier housing halves and an integrated soft comfortable grip.

BACKGROUND OF THE INVENTION

Cutting implements, such as utility knives of the type in which the cutting blade is removable from the handle are well known, the combination of knife blade and handle being typically referred to as a utility knife. Such utility knives are normally available both with retractable blades, such as the type described in U.S. Pat. No. 3,192,624, and with non-retractable blades. Generally, such prior art utility knives comprise the type where two separate complimentary halves are secured together by a screw, such as the type of utility knife manufactured by Stanley Model No. 299, or the type disclosed in U.S. Pat. Nos. 2,376,887; 2,862,296; 2,948,961; 3,062,147; 3,107,426; or 3,192,624. Other prior art utility knives of the non-retractable type have been utilized which have a separate carrier member which pivots into and out of a handle, such as the type disclosed in U.S. Pat. No. 2,245,096. Some of the previously mentioned types of utility knives in which two separable halves are utilized provides for storage of replacement blades within the handle housing but often lack a means for securing these blades within the housing and they rattle around in the knife during storage and often get dull before these blades have had an opportunity to be utilized.

In addition, some such prior art knives are formed of metal die cast housings with a screw to hold the handle together. While the hard die cast housings serve to make the utility knife a durable work tool, the hard surface can be uncomfortable or otherwise ergonomically undesirable leading to blisters. Maintaining a good grip is also a problem with such knives. Additional problems with such knives relates to the use of the attachment screw. Generally, since the screw is centrally located to clamp the blade, a stripped thread will have a tendency to separate the halves and become a hazard. Moreover, since they require use of a screwdriver to remove the halves, the screw makes replacing the blades more difficult and potentially less safe if one slips.

Plastic injection molded utility knives have attempted to address the comfort issue by a dual molding process that combines a rigid plastic housing, typically of polypropylene, with a softer outer cover externally molded thereto, typically made from an elastomeric material such as Santoprene. The surface areas of the two materials chemically adhere due to the nature of the materials. However, these devices lack the safety, durability and feel of the heavier die cast variation as they wear quickly and the sharp blade tends to cut through. Moreover, simply molding an elastomeric material to the exterior of a metallic housing is not possible since such elastomeric material does not bond or adhere to metallic surfaces as it does with compatible plastic surfaces.

Furthermore, in several of these prior art utility knives having separate halves, the portion of the cutting blade that remains in the housing has a tendency to bear against the metal of the housing when pressure is applied to the cutting edge. This typically results in the unused edge becoming dull prior to actual use of the blade.

Accordingly, it is an objective of the invention to provide a non-retractable hardened utility knife with a soft, grippable and securely fixed outer cover.

It is an additional objective of the invention to provide such a knife with a quick and easy means for accessing the blade storage compartment or changing the blade.

It is a further objective to provide such a knife with a construction that protects the internal edge of the cutting blade from being dulled from movement when the external edge of the cutting blade is in use.

It is a still further objective to provide such a device with a frontal bridge near the cutting blade to prevent the housing halves from separation during use and causing injury.

It is another objective to provide such a knife with an economical and efficient method of manufacture.

Additional objectives will be apparent from a review of the preferred embodiment of the invention described herein.

BRIEF DESCRIPTIONS OF THE INVENTION

The present invention is a non-retractable utility knife with housing sections made of metal. These sections align together to form a handle and to hold a blade for cutting. The knife includes a means for releasably engaging the sections that, for preference, is a latch. This provides a way to install the cutting blade or access a blade storage compartment between the sections. A soft cover formed of an elastomeric material is mechanically retained on an exterior portion the housing sections. Preferably, the sections have rivet ports through which integrally formed molded rivets extend from the cover to retain the cover to the housing. The sections also have half channels at internal edges with tabs by which the cover is also retained. Optional flexible posts extend into the blade storage cavity to press against spare blades and impede movement of the spare blades during use of the utility knife. These posts bend as additional spare blades are stacked within. A blade clamp integrally formed with the cover protrudes against a side of the cutting blade to limit the blade's lateral movement. The housing sections interlock by tongue and groove near the cutting blade opposite the latch.

The invention further includes a novel method for making the utility knife housing. The method involves casting the utility knife housing in a first mold with molten metal such as zinc or aluminum. A mold in this die casting process includes mechanical or structural features to shape the housing for retaining a subsequently formed soft cover around the housing. In the subsequent injection molding process, the soft cover and its integrated features are then formed directly onto the previously die cast knife housing. The mold in this second process receives the utility knife housing and the soft cover is subsequently formed by injection molding an elastomer to and around the inner knife casting.

DETAILED DESCRIPTION OF THE INVENTION

Figure 1:
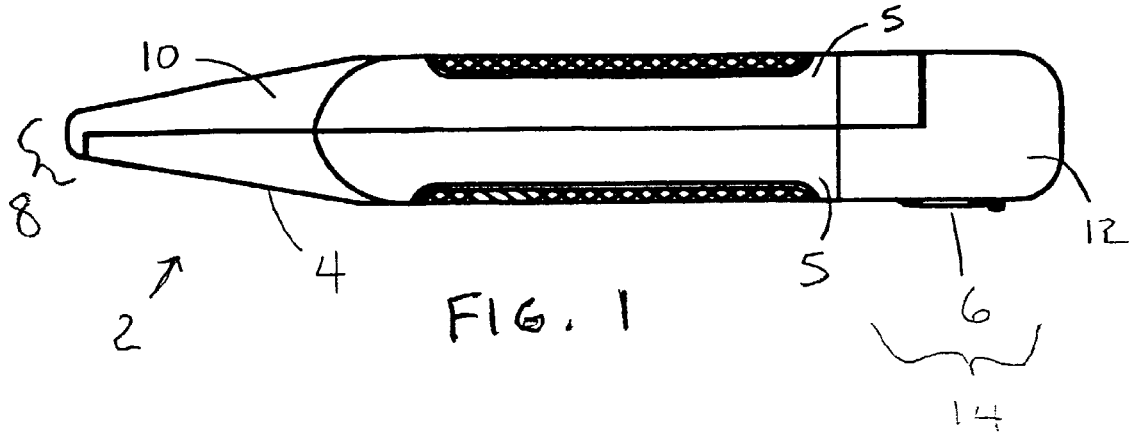
FIG. 1 is a top elevation view of a utility knife assembly of the invention.
Figure 2:
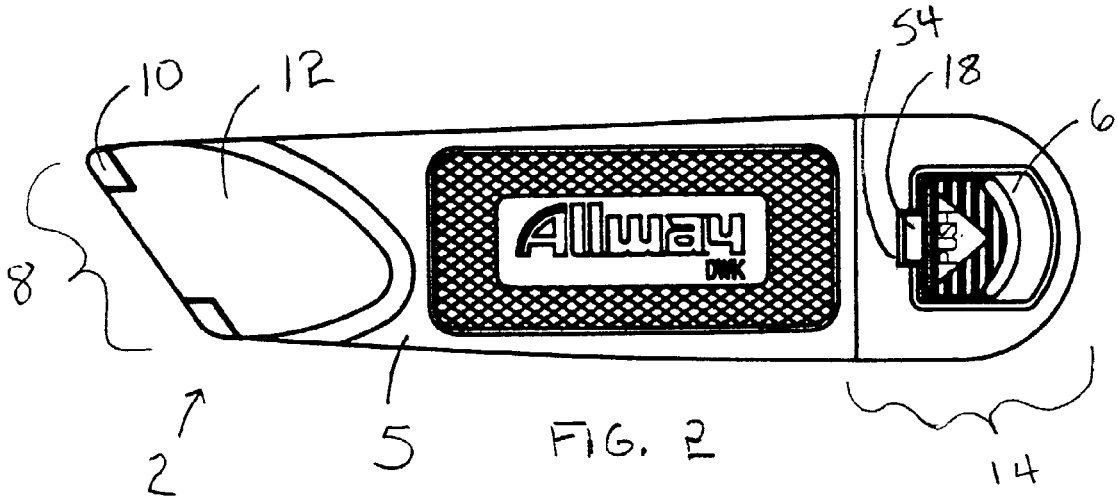
FIG. 2 is a side elevation view of the utility knife assembly of FIG. 1.
Figure 3:
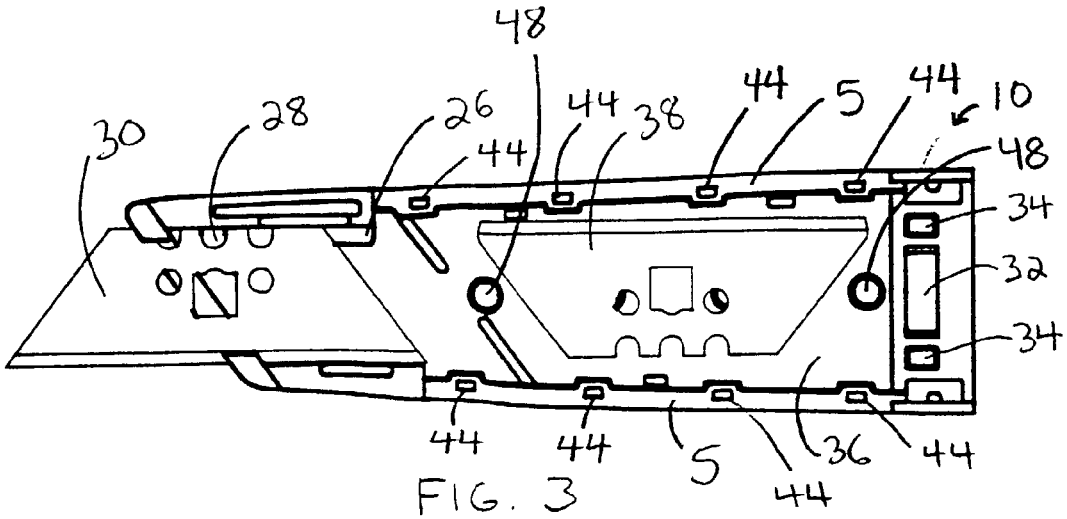
FIG. 3 is an internal elevation view of a mount side of the housing of the assembly of FIG. 1 with blades and latch inserted.
Figure 4A:
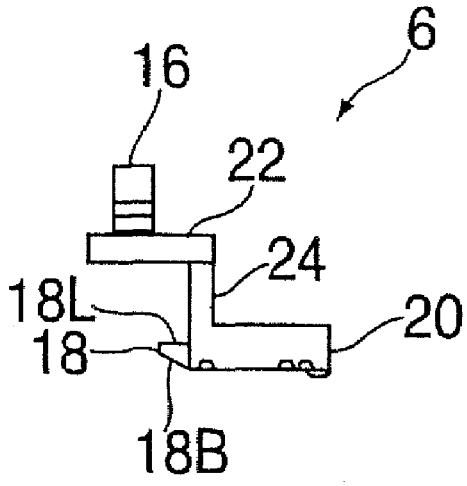
FIG. 4A is a top plan view of the quick release latch of FIG. 4.
Figure 4B:
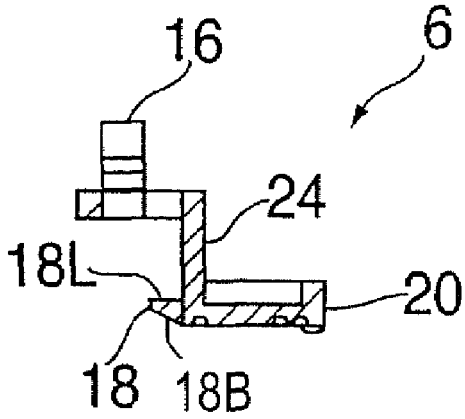
FIG. 4B is a sectional view of the latch of FIG. 4 taken along line A-A of FIG. 4.
Figure 4:
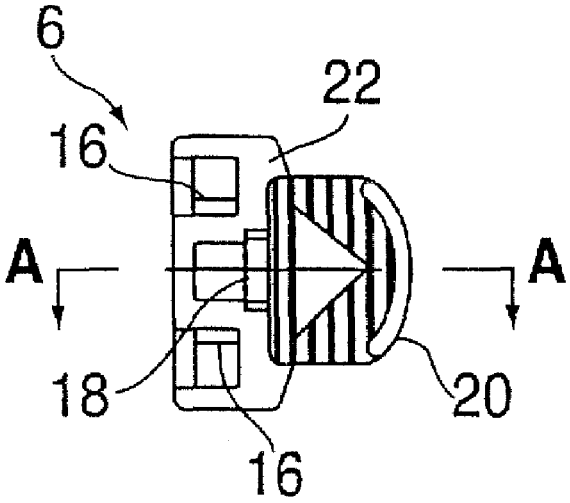
FIG. 4 is an elevation view of a quick release latch from the embodiment of the invention of FIG. 1.
Figure 4C:
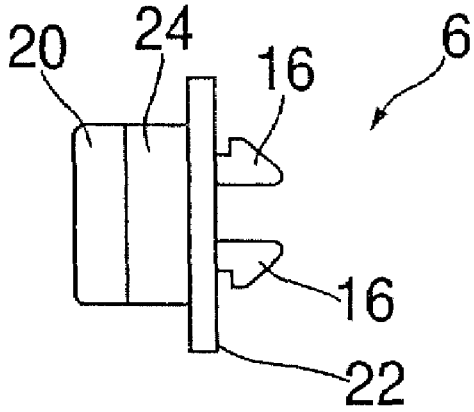
FIG. 4C is a side plan view of the quick release latch of FIG. 4.
Figure 5:
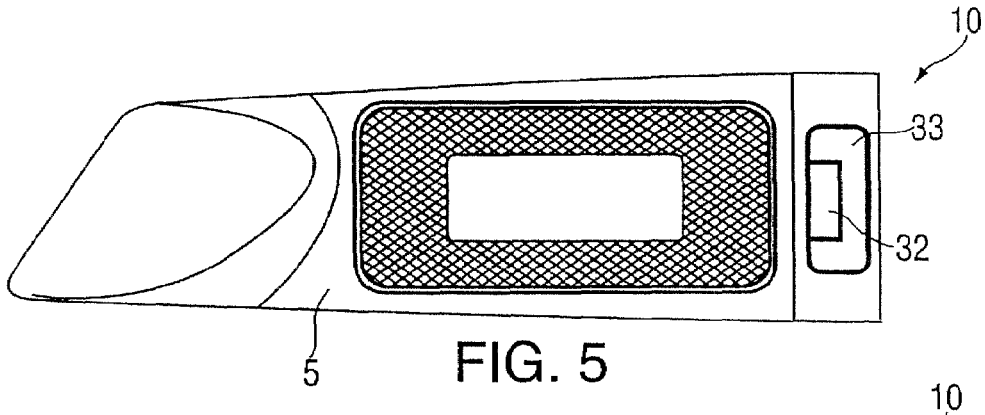
FIG. 5 is an external elevation view of a mount side of the housing of the assembly of FIG. 1 with soft outer cover.
Figure 6:
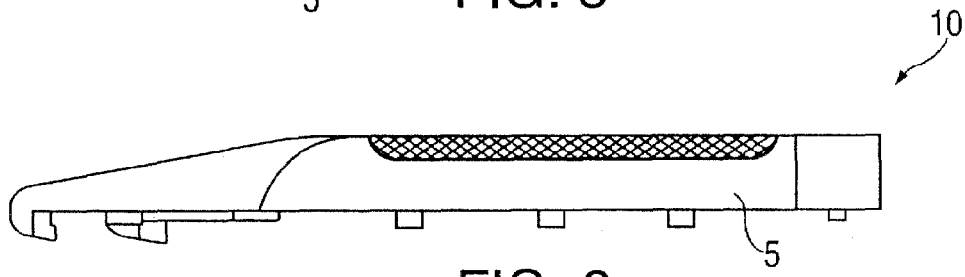
FIG. 6 is a top elevation of the mount side of FIG. 5.
Figure 7:
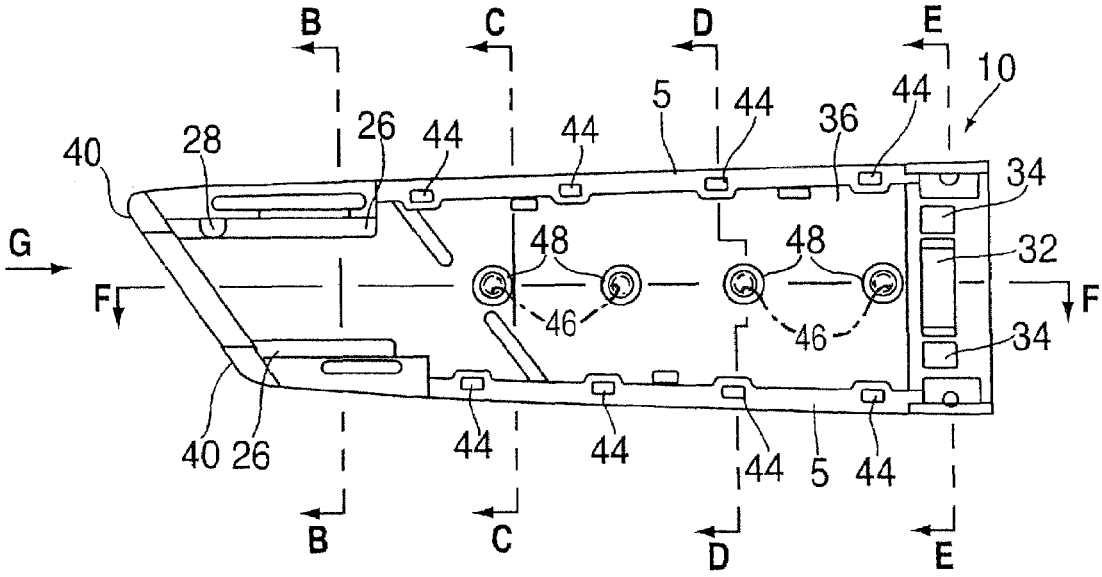
FIG. 7 is an internal elevation view of the mount side of FIG. 5.
Figure 8:
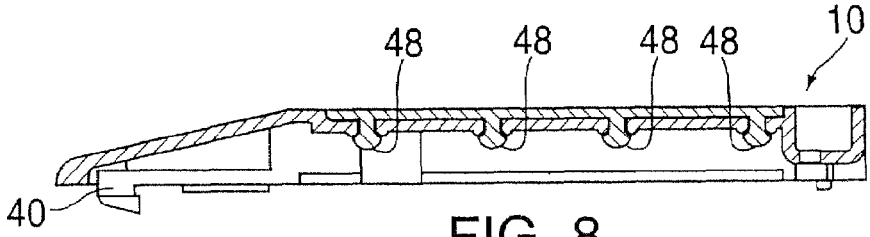
FIG. 8 is a sectional view of the mount side of FIG. 7 taken along line F-F of FIG. 7.
Figure 9:
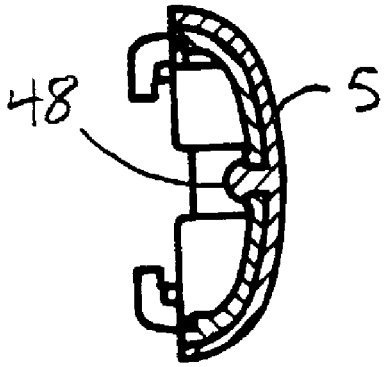
FIG. 9 is a sectional view of the mount side of FIG. 7 taken along line D-D of FIG. 7.
Figure 10:
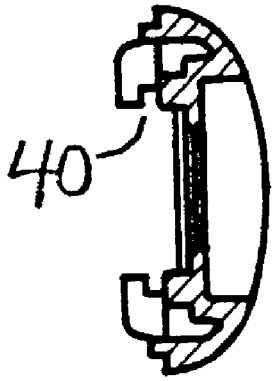
FIG. 10 is a sectional view of the mount side of FIG. 7 taken along line E-E of FIG. 7.
Figure 11:
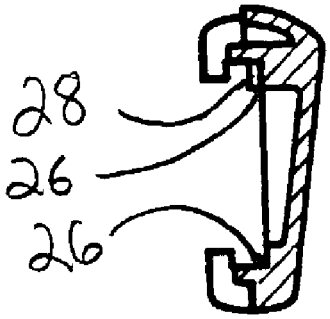
FIG. 11 is a sectional view of the mount side of FIG. 7 taken along line B-B of FIG. 7.
Figure 12:
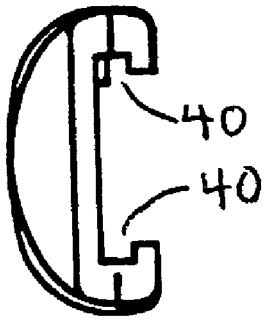
FIG. 12 is an elevation view of the mount side of FIG. 7 in the direction of sight of arrow G of FIG. 7.
Figure 13:
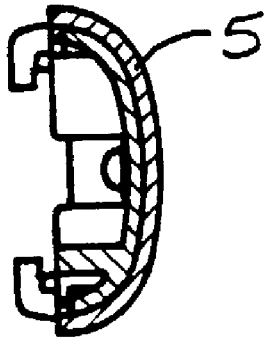
FIG. 13 is a sectional view of the mount side of FIG. 7 taken along line C-C of FIG. 7.

With reference to FIGS. 1 and 2, a utility knife assembly 2 of the invention includes a housing 4, a gripping cover 5 and a quick release latch 6. Generally, the housing 4 is configured to serve as a handle and secure a cutting blade in a cutting position extending into and from the housing 4 at a cutting portion 8 of the housing 4. The housing 4 has two corresponding housing sections with complementing structures. When joined by the latch 6, the two sections form the knife assembly 2. The housing sections include a mount side 10 and a release side 12. These housing sections are joined by interlocking structures at the cutting portion 8 of the housing 4 and by the quick release latch 6 at a latching portion 14. The housing 2 is preferably made of a die-cast metal, such as zinc or aluminum or other moldable metal alloy, to form a hard, durable handle for the utility knife assembly 2. The gripping cover 5 is made from a soft molded elastomer such as Santoprene. The latch 6 is a preferably firm resilient engineering plastic with some limited flexibility, e.g., Celcon acetal resin, Lexan polycarbonate or nylon.

The quick release latch 6 provides a means for releasably engaging the housing sections at the latching portion 14. FIGS. 4, 4A, 4B and 4C depict one embodiment of the latch 6 in detail. The latch 6 is molded to complement related structural features of the housing sections. The latch 6 includes locking tabs 16 extending from the latch base 22 for fixing the latch 6 to the mount side 10 of the housing 4. The latch 6 includes a latching tongue 18 to releasably engage with the release side 12 of the housing 2. The latching tongue 18 is adjacent to a finger tab 20. The latching tongue 18 has a beveled side 18B opposite a latching side 18L.

The finger tab 20 is incorporated to the latch base 22 by a flexing support 24. The finger tab 20 extends from the flexing support 24 to form a lever such that when a pushing force is applied to the finger tab 20 when the latch base is fixed to the housing 4, the flexing support 24 bends elastically in a lateral direction. With such bending, the latch 6 can release the engagement of the two sections as the latching tongue 18 moves. Similarly, the beveled side 18B serves to convert a closing force into a lateral bending force on the flexing support 24 of the latch 6 as a housing section is forced against the bevel when the assembly 2 is manipulated from its open position to its closed position. Since the latch 6 is made from a firm material with limited flexibility, after bending of the flexing support 24, it will return to its original molded unbent configuration to securely engage the housing sections when the assembly is in the closed position.

As previously noted, the housing 4 includes a mount side 10. The mount side 10 is generally depicted in FIGS. 3, 5-13 with the cover 5 molded thereon and in FIGS. 24-32 before molding the cover thereon. The mount side 10 includes blade ledges 26 and a blade positioning tab 28 to align a cutting blade 30 in a non-retractable position at the cutting portion 8. The mount side 10 of the housing 4 also has a mounting aperture 32 and mounting studs 34 at the latching portion 14. The mounting aperture 32 is sized to lock on the locking tabs 16 of the latch 6 such that ridges of the locking tabs 16 engage the external surface edges 33 of the mounting aperture 32 when the locking tabs 16 are inserted therein. The mounting studs 34 are positioned and sized to reside in corresponding holes in the latch base 22.

The mount side 10 preferably includes a blade store cavity 36 to retain spare blades 38. At the cutting portion 8, the mount side 10 includes opposing grooves 40. The grooves 40 serve to interlock the mount side 10 to the release side 12 when these housing sections are joined. The cutting blade 30 passes through the grooves 40 when installed in a non-retractable cutting position in the assembly 2.

The mount side 10 has several features designed to mechanically secure a portion of the gripping cover 5 to the housing 4 at the mount side 10. At a portion of the internal edges of the mount side 10 are half channels 42 with several cover holding tabs 44. The half channels 42 serve as a mold to receive the part of the gripping cover 5 attached to the mount side. Since the half channels 42 surround the holding tabs 44, the gripping cover 5 is retained by the cover holding tabs 44. The mount side 10 also includes rivet ports 46 to receive molded rivets 48 that are integrally formed with the gripping cover 5. The molded rivets 48 are formed within the housing 4 so that the head portion of each rivet within the housing 4 is larger than the rivet ports 46 and resides next to each rivet port. This serves to keep the molded rivets 48 from moving or passing out through the rivet ports 46 to thereby assist with holding the gripping cover 5 on the housing 2.

The release side 12 of the housing 4 is depicted in FIGS. 14-23 with the cover 5 and in FIGS. 33-42 prior to the molding of the cover 5 thereon. The release side 12 has a structure to interlock with the grooves 40 of the mount side 10 and a structure to releasably engage with the latch 6 at the latching tongue 18. At a cutting portion 8 the release side 12 has mating tongues 50 arranged to reside within the grooves 40 and interlock therewith. The release side 12 further has a latch aperture 52 to receive the finger tab 20. A latching tongue indent 54 lies adjacent to the latch aperture 52. The external surface of this latching tongue indent 54 engages with the latching tongue 18 at the latching side 18L to releasably engage the housing sections when the housing sections are aligned and interlocked with the mating tongues 50 in the groves 40 and when the latch 6 is in the latch aperture 52. This configuration corresponds with the assembly 2 being in its closed position.

The release side 12 of the housing 4 also includes a half channel 42 along a portion of its edges as well as several rivet ports 46. The channels also include several cover holding tabs 44 to mechanically hold the portion of the gripping cover 5 on the release side 12 of the housing 4 in a similar fashion as that of the portion of the gripping cover 5 on the mount side 10 of the housing 4. Preferably, the half channels 42 from each housing section are aligned at internal edges so that they reside between the housing sections when the assembly 2 is in its closed position. Additionally, opposing cover holding tabs 44 on the opposing housing sections may also be aligned with each other. These alignments provide for an additional mechanical hold on the gripping cover 5 by holding the edges of the gripping cover 5 between the closed housing 4 and inhibiting the gripping cover from being pulled over the cover holding tabs 44 within each half channel 42 as the opposing cover holding tabs 44 contact or otherwise reside near each other when the housing 4 is closed.

As an integral part of the portion of the gripping cover 5 on the release side 12, flexible posts 56 protrude beyond the cavity of the release side, extending well into the blade store cavity 36 of the mount side 10 of the housing 2. These flexible posts 56 provide a means to prevent movement of the spare blades 38. When the assembly 2 is in its closed position with spare blades 38 enclosed in the blade store cavity 36, the flexible posts 56 press against one or more spare blades 38. Since they are flexible, the protruding posts will bend but still apply pressure against the spare blades 38. As the stack reduces in height, the flexible posts 56 straighten to accommodate a varying number of spare blades. With this device, the spare blades 38 within the housing will not rattle regardless of the number of spare blades. This also serves to prevent the spare blades 38 from becoming dull as a result of being jostled against the internal structures of the housing 2 during use. To enable the flexible posts 56 to also serve a function of holding the gripping cover 5 to the housing 4, at their base the flexible posts 56 include molded rivets 48 to impede the flexible posts 56 from passing out through the rivet ports 46. Thus, these flexible molded rivets 48 secure the outer soft gripping cover 5 to the cast housing 4 on the release side 12. Conversely, since the gripping cover 5 is formed integrally with the flexible posts 56, the gripping cover 5 through one or more rivet ports 46 serves to secure the flexible posts 56 to the release side 12.

Figure 14:
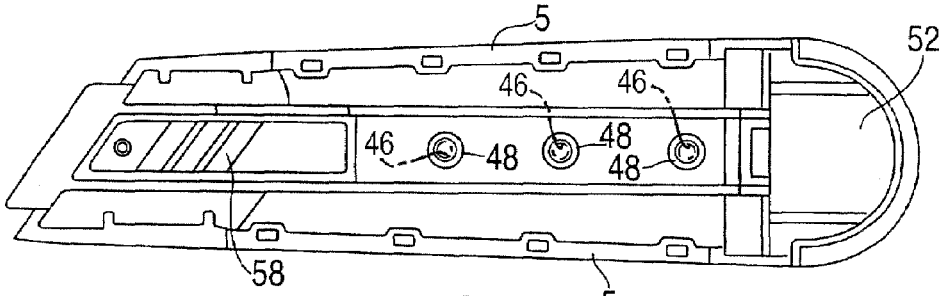
FIG. 14 is an internal elevation view of a release side of the housing of the assembly of FIG. 1 with soft outer cover and soft inner projections.
Figure 15:
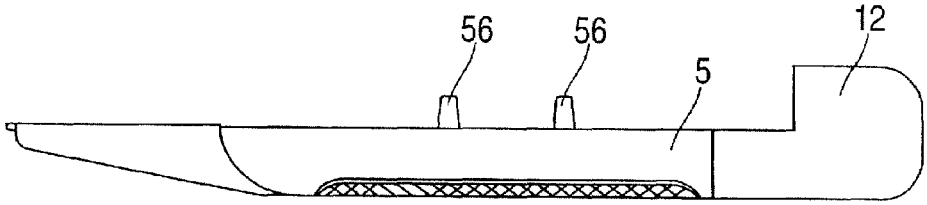
FIG. 15 is a top elevation of the release side of FIG. 14.
Figure 16:
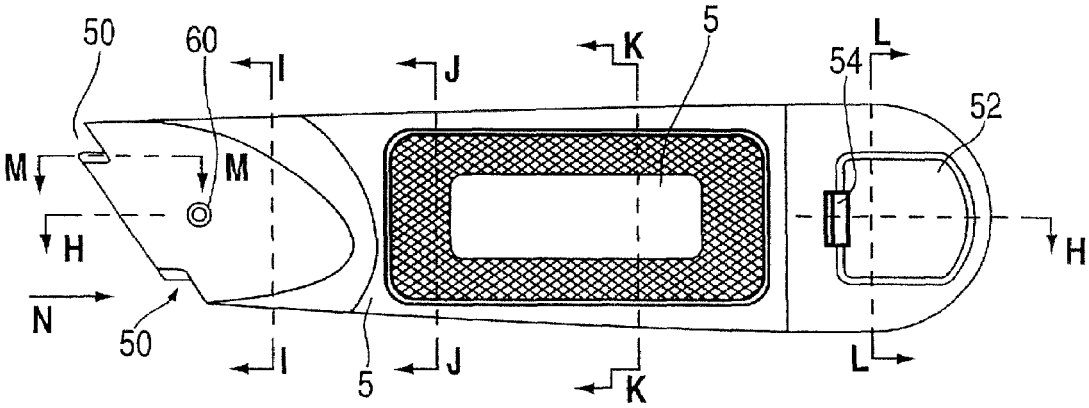
FIG. 16 is a external elevation of the release side of FIG. 14.
Figure 17:
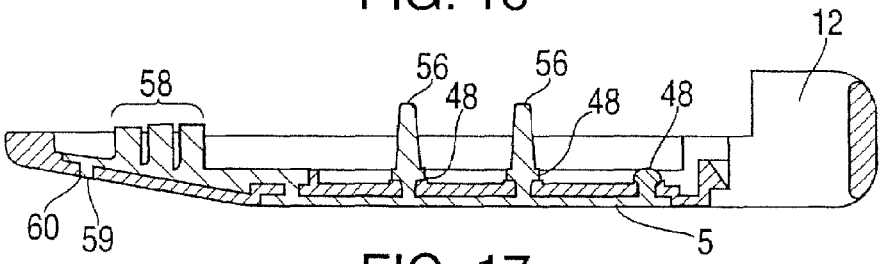
FIG. 17 is a sectional view of the release side of FIG. 14 taken along line H-H of FIG. 14.
Figure 18:
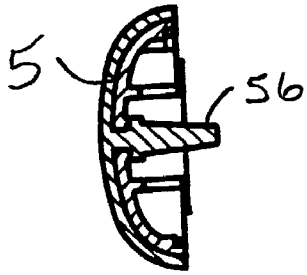
FIG. 18 is a sectional view of the release side of FIG. 14 taken along line K-K of FIG. 16.
Figure 19:
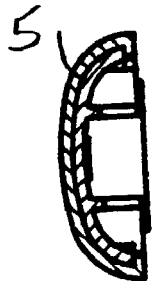
FIG. 19 is a sectional view of the release side of FIG. 14 taken along line J-J of FIG. 16.
Figure 20:
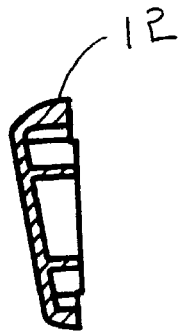
FIG. 20 is a sectional view of the release side of FIG. 14 taken along line I-I of FIG. 16.
Figure 21:
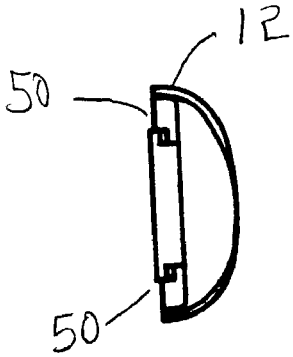
FIG. 21 is an elevation view of the release side of FIG. 14 in the direction of sight of arrow N of FIG. 16.
Figure 22:
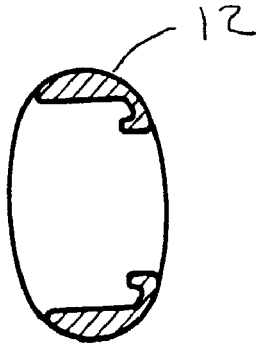
FIG. 22 is a sectional view of the release side of FIG. 14 taken along line L-L of FIG. 16.
Figure 23:
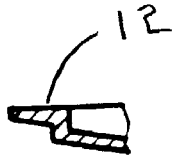
FIG. 23 is a partial sectional view of the release side of FIG. 14 taken along line M-M of FIG. 16.
Figure 24:
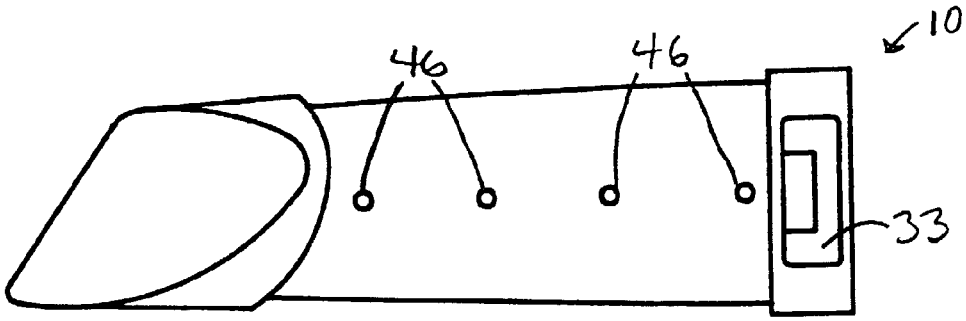
FIG. 24 is an external elevation view of the mount side of FIG. 5 before a soft outer cover is molded to it.
Figure 25:
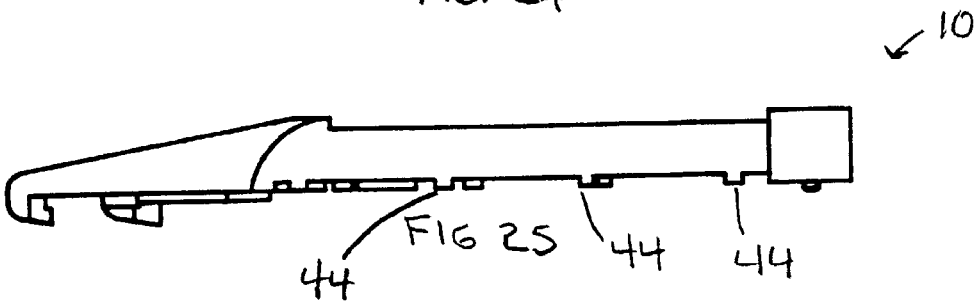
FIG. 25 is a top elevation of the mount side of FIG. 24, casting only.
Figure 26:
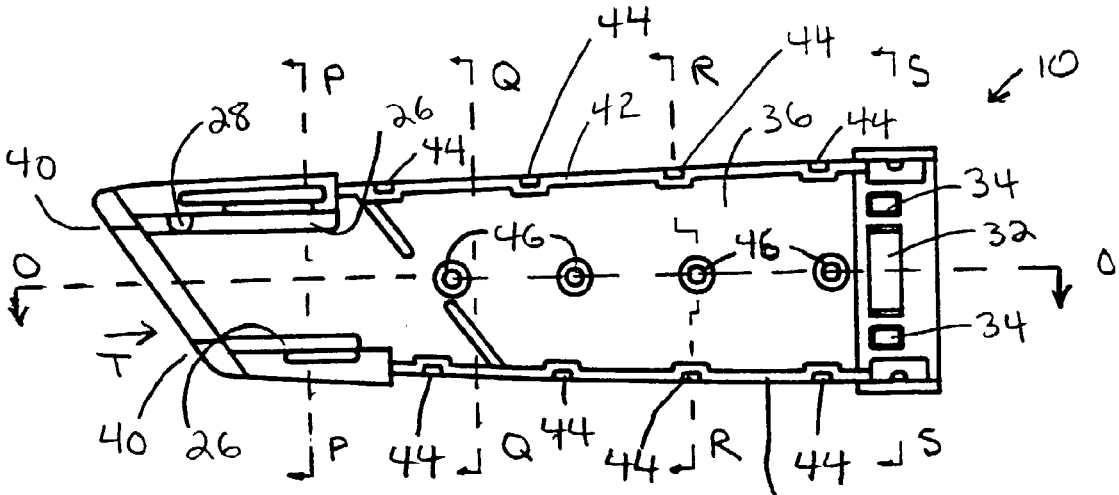
FIG. 26 is an internal elevation view of the mount side of FIG. 24.
Figure 27:
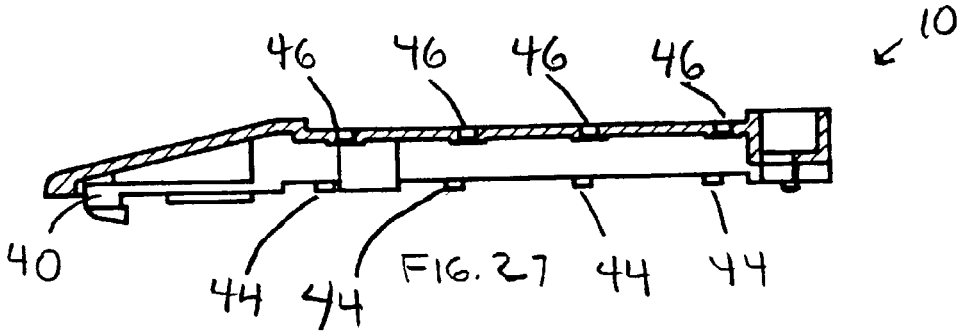
FIG. 27 is a sectional view of the mount side of FIG. 24 taken along line O-O of FIG. 26.
Figure 28:
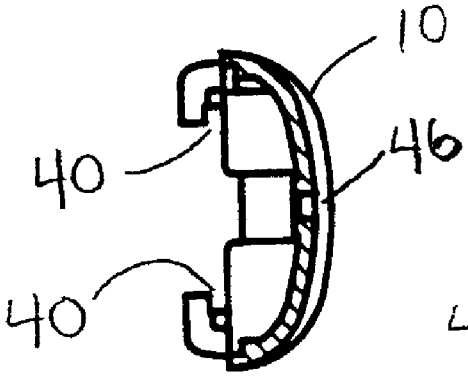
FIG. 28 is a sectional view of the mount side of FIG. 24 taken along line R-R of FIG. 26.
Figure 29:
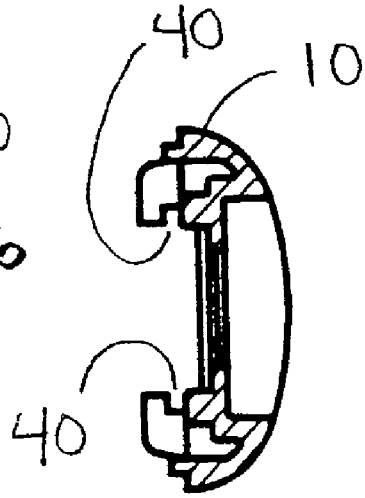
FIG. 29 is a sectional view of the mount side of FIG. 24 taken along line S-S of FIG. 26.
Figure 30:
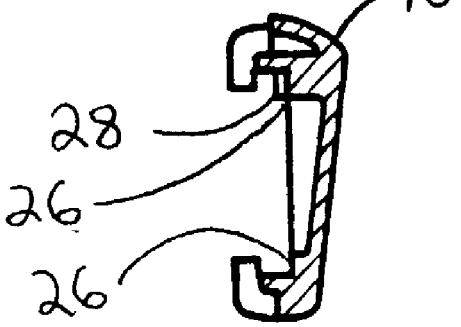
FIG. 30 is a sectional view of the mount side of FIG. 24 taken along line P-P of FIG. 26.
Figure 31:
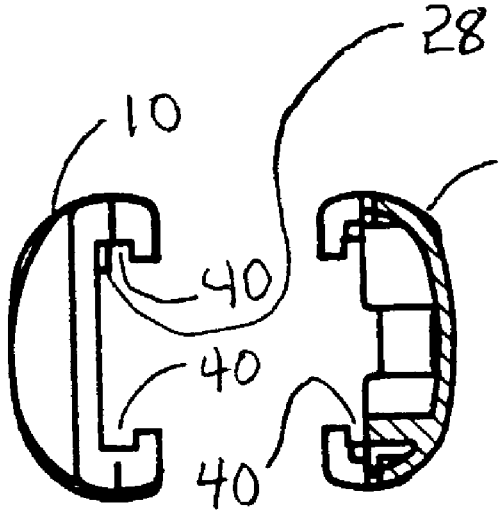
FIG. 31 is an elevation view of the mount side of FIG. 24 in the direction of sight of arrow T of FIG. 26.
Figure 32:
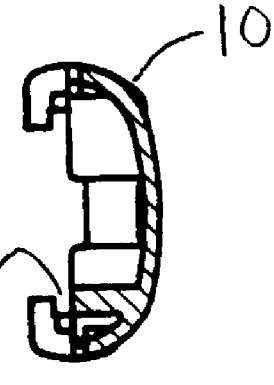
FIG. 32 is a sectional view of the mount side of FIG. 24 taken along line Q-Q of FIG. 26.
Figure 33:
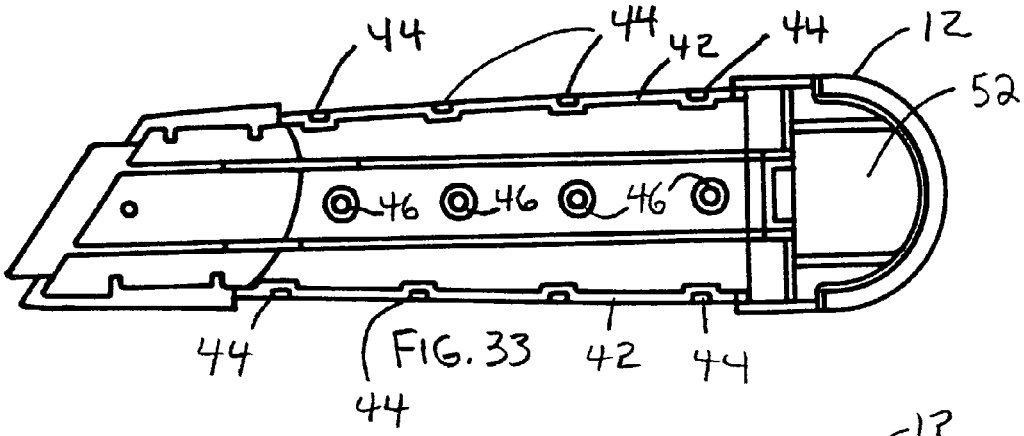
FIG. 33 is an internal elevation view of the release side of FIG. 14 without an overmolded soft outer cover.
Figure 34:
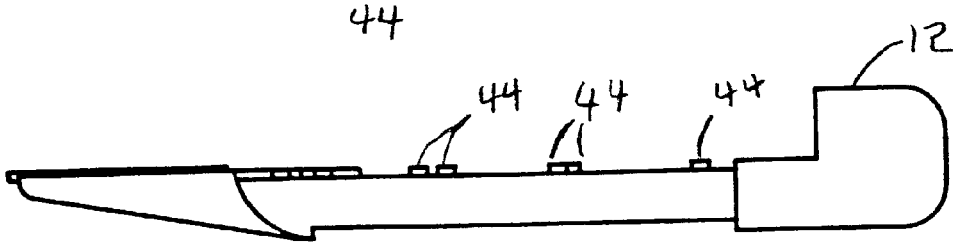
FIG. 34 is a top elevation of the release side of FIG. 33, inner casting only.
Figure 35:
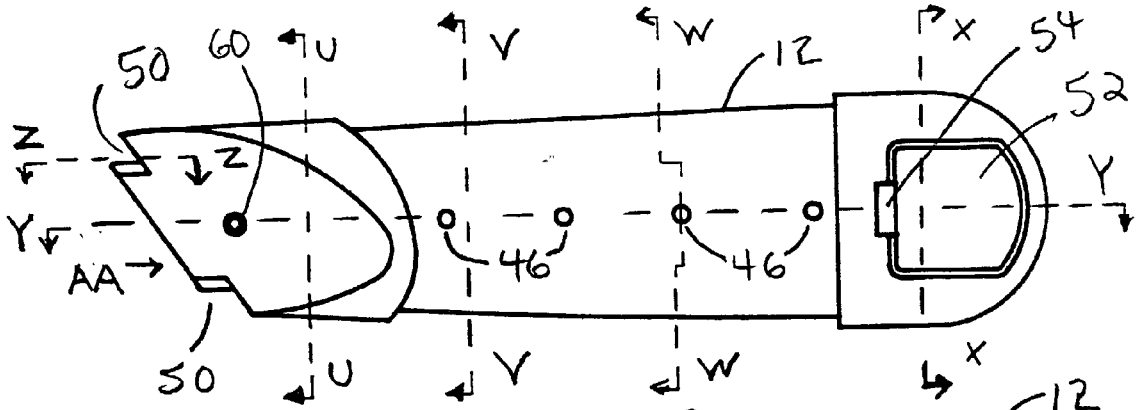
FIG. 35 is an external elevation view of the release side of FIG. 33.
Figure 36:
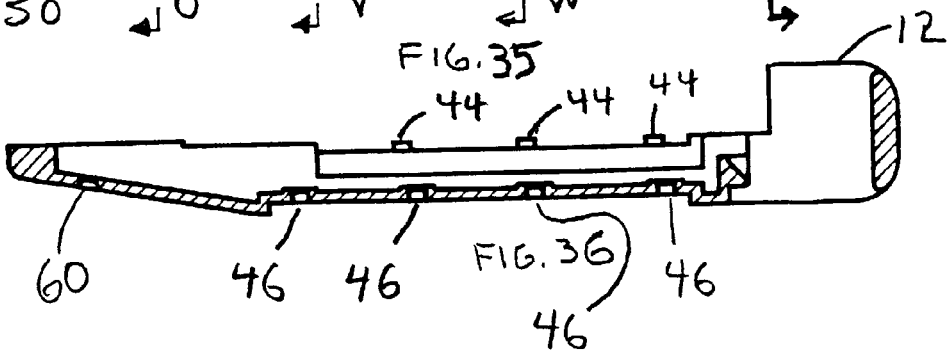
FIG. 36 is a sectional view of the release side of FIG. 33 taken along line Y-Y of FIG. 35.
Figure 37:
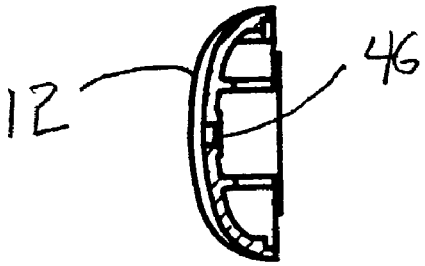
FIG. 37 is a sectional view of the release side of FIG. 33 taken along line W-W of FIG. 35.
Figure 38:
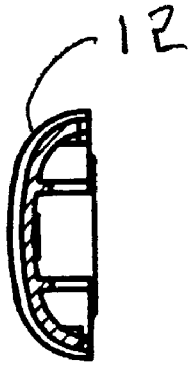
FIG. 38 is a sectional view of the release side of FIG. 33 taken along line V-V of FIG. 35.
Figure 39:
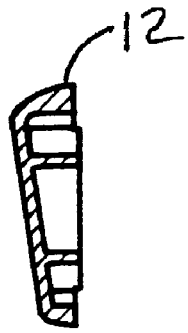
FIG. 39 is a sectional view of the release side of FIG. 33 taken along line U-U of FIG. 35.
Figure 40:
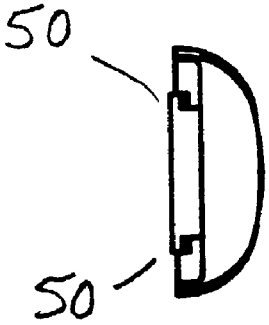
FIG. 40 is an elevation view of the release side of FIG. 33 in the direction of sight of arrow AA of FIG. 35.
Figure 41:
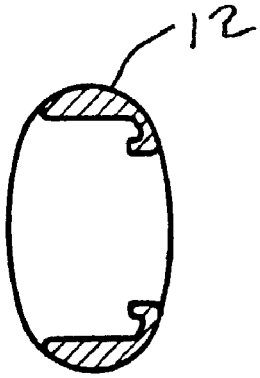
FIG. 41 is a sectional view of the release side of FIG. 33 taken along line X-X of FIG. 35.
Figure 42:
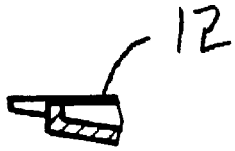
FIG. 42 is a partial sectional view of the release side of FIG. 33 taken along line Z-Z of FIG. 35.

As shown in FIGS. 14 and 17, a flexible blade clamp 58 is another integral feature of the gripping cover 5 that extends within the release side 12 of the housing 4. In conjunction with the blade positioning tab 28 and the blade ledges 26, the flexible blade clamp 58 assists in securing the cutting blade 30 in a cutting position in the assembly 2. More specifically, the blade clamp 58 provides for lateral support of the cutting blade between the housing sections. In the preferred embodiment of the blade clamp 58, three protrusions extend toward the blade a sufficient distance to flexibly apply pressure or squeeze against the cutting blade 30 when the assembly 2 is in its closed position to limit lateral movement of the cutting blade. The flexible nature of these protrusions permits blades of varying sizes to be held firmly. Moreover, since the blade clamp 58 is integrally formed with the gripping cover 5 through one of the rivet ports 46 of the release side 12, its location inside the housing 4 serves the further purpose of providing an additional mechanical hold on the gripping cover 5 to keep the gripping cover 5 fixed to the housing 4. An additional hold down pin 59 formed as an integral part of the flexible blade clamp 58 resides in a pin port 60 in the release side 12 of the housing 4.

In use the assembly 2 provides a safe, sturdy and functional utility knife. From its closed position, the assembly 2 may be opened by pressing the user's finger against the finger tab 20, to force the latching tongue 18 away from its contact at the latching side 18L with the latching tongue indent 54 of the release side 12 of the housing 2. Upon release, the release side 12 may be separated from the mount side 10 by withdrawing the mating tongues 50 of the release side 12 from the grooves 40 of the mount side 10 at the cutting portion 8 of the housing 4. A spare blade 38 can be removed from the blade store cavity 36. The blade can then be placed on the blade ledges 26 on the blade positioning tab 28 under the grooves 40 at the cutting portion 8 of the mount side 10 of the housing 4.

To close the assembly 2, the mating tongues 50 of the release side 12 are inserted into the grooves 40 of the mount side 10. The release side 12 may then be aligned so that the latch aperture 52 of the release side 12 moves over the finger tab 20 of the latch. As the release side 12 and mount side 10 are pressed together, the latching tongue 18 moves away from the latching tongue indent 54 as the release side traverses the surface of the beveled side 18B of the latching tongue 18 on the latch 6. Simultaneously, the flexible posts 56 from the release side 12 are forced to bend against any remaining spare blade 38 in the blade store cavity 36 of the mount side 10 of the housing 4. Similarly, the flexible blade clamp 58 is forced against the cutting blade 30. When the latching tongue indent 54 passes the latching side 18L of the latching tongue 18, the latching tongue will return to its unbent position to contact the surface of the latching tongue indent 54, thereby engaging the release side 12 and the mount side 10 of the housing 4.

Once locked closed, the assembly 2 may be used for cutting by grasping the assembly at the gripping cover 2. Since the gripping cover 2 is mechanically attached to the housing 4 by (a) the flexible blade clamp 58, (b) the molded rivets 48, (c) edge portions of the cover residing in the interior aligned half channels 42 and looped around or otherwise surrounding the cover holding tabs 44, the gripping cover 2 provides a firmly retained, non-slip outer skin for ergonomic comfort.

Despite the intricacies of the combined features of the assembly, a unique manufacturing process may be followed to reduce assembly of the various features during manufacture of the invention. To this end, while the gripping cover 5, the blade clamp 58, the flexible posts 56 and the molded rivets 48 may be manufactured as separate components and combined in a final assembly with all or some of the components, it is preferred to have some or all of these features applied to the housing sections of the housing 4 in a common process. Thus, the invention includes a methodology in which the internal and external soft structural features of the gripping cover 2 are manufactured onto either housing section in a single injection molding process.

The steps to accomplishing the method include the preparation of corresponding housing sections in a mold or molds. The molds include the reverse shapes of the separate housing sections of the utility knife particularly with the structural features for fastening or retaining the gripping cover 5 on exterior portions of the housing 4. Thus, a mold is optionally made to include half channels 42, cover holding tabs 44, and/or rivet ports 46. Those skilled in the art would understand the steps of creating such a mold. With one or more of such molds, the housing sections are cast in a first metal casting process by pressure casting molten metal into the mold.

Similarly, one or more molds are made to receive each cast metal housing section. The molds have reverse shapes to correspond with the surface of the gripping cover 2 and its integrated parts such as the interior retaining portions that hold the gripping cover 5 to the housing 4. Thus, the preferred release side 12 mold would include structures for forming internal features including barriers for the portion of the gripping cover 5 in the half channels 42, the interior portions of the blade clamp 58, the interior portions of the flexible posts 56 and the interior portions of the molded rivets 48. The preferred mount side 10 mold would include barriers for the portion of the gripping cover 5 in the half channels 42 and the interior portions of the molded rivets 48. Of course, due to the structures of the mount side 10 and the release side 12 which will be included in the molding process, these housing sections themselves serve as an important part of the structure of the mold. In the secondary elastomer molding process, the gripping cover 5 with its incorporated features is cast by injecting an elastomer as a hot liquid into each mold with a corresponding housing section contained therein. The liquid elastomer then moves over an exterior cover portion of the housing section, through the various rivet ports 46 and into the half channels 42 of the housing section to form the gripping cover 5 with its integrated features. The latch 6 formed from another mold may then be installed in the cooled housing sections by attaching one to a mount side 10 and a release side 12.

Basically, the tool ends up being an extremely simple and safe two-piece knife with a soft and comfortable grip. It is safe as the user's hand does not slip. It is convenient as the cutting blade can be changed readily without the use of a screwdriver or other tool. It is accurate since the blade is clamped during use and cuts straight. It is strong since the blade will not move during cutting. Its razor sharp spare blades do not shake or dull during use or transport, thereby promoting safety. A sharp blade is a safe blade. In its preferred form, it is the only two-piece non-retractable utility knife without loose or moving parts.

Although the invention is described in terms of a particular embodiment, it is to be understood that the embodiment is merely illustrative of an application of the principles of the invention. Numerous modifications may be made and other arrangements may be devised without departing from the spirit and scope of the invention as defined by the claims. For example, although a latch is the preferred means for releasably engaging the other housing sections, alternatives might be used for example, a screw.

The invention claimed is:

1. A utility knife comprising:

a first housing section of metal and a second housing section of metal, both with corresponding structures to align together to form a handle and to hold a blade in a cutting location between the first housing section and the second housing section;

means for releasably engaging the first housing section and the second housing section in a closed position;

a first soft cover member retained on an exterior portion of the first housing section and a second soft cover member retained on an exterior portion of the second housing section, said soft cover members being formed of an elastomeric material;

a first port on said first housing section and a second port on said second housing section, said port on said first housing section being positioned adjacent to said first soft cover member, and said port on said second housing section being positioned adjacent to said second soft cover member;

a first rivet extending from said first soft cover member through said first port to an interior formed by the first housing section and the second housing section, and a second rivet extending from said second soft cover member through said second port to said interior formed by the first housing section and the second housing section, wherein each of said rivets comprise a portion larger than said ports within said interior to retain said first soft cover member and said second soft cover to said first housing section and said second housing section, respectively;

a first ledge at an internal edge of the first housing section and a second ledge at an internal edge of the second housing section, wherein said first soft cover member further comprises edge portions on said first ledge, and said second soft cover member further comprises edge portions on said second ledge; and a first tab on said first ledge and a second tab on said second ledge, wherein said edge portions of said first soft cover member and said second soft cover member encircle said tabs;

wherein there is a close-fitting mechanical connection between said first and second soft cover members and said first and second housing sections, respectively.

2. The utility knife of claim 1 wherein one of said first and second soft cover members further comprises a blade clamp protruding and squeezing against a side of said blade in the cutting location between said first housing section and said second housing section when engaged in said closed position.

3. The utility knife of claim 1 wherein said means for releasably engaging is a semi-flexible latch.

4. The utility knife of claim 3 wherein said latch comprises:

a base for attachment to said first housing section;

a flexible support extending from said base;

a latching tongue and finger tab extending from said flexible support;

wherein said latching tongue is positioned on said flexible support to be received by an indent of said second housing section when said latch engages the first housing section and the second housing section in the closed position.

5. A utility knife comprising:

a first housing section of metal and a second housing section of metal, both with corresponding structures to align together to form a handle and to hold a blade in a cutting location between the first housing section and the second housing section;

means for releasably engaging the first housing section and the second housing section in a closed position;

a first soft cover member retained on an exterior portion of the first housing section and a second soft cover member retained on an exterior portion of the second housing section, said soft cover members being formed of an elastomeric material;

wherein at least one of said first soft cover member and said second cover member comprises a flexible post extending into a blade storage cavity in an interior portion of at least one of said first housing section and said second housing section to press against one or more spare blades in said storage cavity when said first housing section and said second housing section are in said closed position; and further wherein there is a close-fitting mechanical connection between said first and second soft cover members and said first and second housing sections, respectively.

6. The utility knife of claim 5 wherein said flexible post comprises a rivet in an interior of at least one of said first housing section and said second housing section.

* * * * *